United States Patent [19]

Stone

[11] Patent Number: 5,050,521

[45] Date of Patent: Sep. 24, 1991

[54] MOORING LINE SYSTEM

[76] Inventor: John A. Stone, 1407 Seagull Ct., Punta Gorda, Fla. 33950

[21] Appl. No.: 514,209

[22] Filed: Apr. 25, 1990

[51] Int. Cl.[5] ..... B63B 21/00

[52] U.S. Cl. ..... 114/230

[58] Field of Search ..... 114/220, 230, 219; 14/76; 405/212-215

[56] References Cited

U.S. PATENT DOCUMENTS

Re. 27,050 2/1971 Jorgenson ..... 114/230

FOREIGN PATENT DOCUMENTS 1541167 2/1979 United Kingdom ..... 114/220

*Primary Examiner*—Ed Swinehart

*Attorney, Agent, or Firm*—Frank A. Lukasik

[57] ABSTRACT

The invention is a boat mooring apparatus to allow for ease of travel up and down dock piling posts in such a fashion that it is free to move vertically with changes in tide. It comprises a mooring line roller and chafe resistor which includes a ribbed tube and spools or rollers mounted on the tube and fitted over the mooring lines. The invention is fitted on the dock lines and around the dock posts and tied to the cleats of a vessel to be moored.

2 Claims, 1 Drawing Sheet

MOORING LINE SYSTEM

BACKGROUND OF THE INVENTION

1. Field of the Invention

This invention relates generally to boat mooring apparatus, and more specifically to apparatus to allow for ease of travel up and down dock piling posts to which a vessel may be tied or moored in such a fashion that it is free to move vertically with changes in tide.

2. Discussion of the Prior Art

As described in U.S. Pat. No. 4,480,576 to Mills, in areas having significant tide differences, a problem arises in mooring a boat to a dock or a pier in that it is necessary to leave the lines sufficiently slack to permit rise and fall of the boat with the tide and yet have the line tight enough to anchor the boat sufficiently to prevent damage from beating against the dock resulting in possible damage to the craft and the dock. In accordance with the teachings of the Mills patent, the boat mooring system comprises a pair of spaced apart support braces which are fixedly secured to a dock. Attached to the braces and projecting vertically downward into the water for a predetermined distance are cylindrical posts. Cooperating with each of the spaced-apart vertical posts is a carriage arrangement comprising a generally U-shaped bracket or collar having roller members extending across the open end of the U and arranged to ride up and down the outer surfaces of the cylindrical posts. Mooring lines are used to couple the boat to the movable carriage members. The mooring system requires a permanent arrangement on the dock or pier and the U shaped member is a part of the permanent system.

Another boat mooring system is disclosed in U.S. Pat. No. Re. 27,050 to Jorgenson which provides a mooring harness or cable and cleat which permits rapid manual encirclement of the cable around one of his mooring members and the engagement of the cable latch with the cleat member by a sequence of movements. Jorgenson also shows a portion of the bight of the cable on which he disposes beads to reduce cable wear as the cable rises and falls while in contact with a mooring member. Each of the prior art patents are limited to the specially designed vertical posts and the mooring harnesses which are located at set distances for a single boat length. Neither of the prior art systems are adaptable to the many different mooring conditions found at the many different marinas which cruising boaters encounter during extended trips. Furthermore, the complex, downwardly extending posts, are cumbersome and expensive to fabricate. In addition, the posts become encrusted by marine life which interferes with the ability of the float to move up and down.

SUMMARY OF THE INVENTION

The present invention is placed around and upon the dock post or piling, with the vessel's dock line or mooring line in place inside the invention. When installed in this manner, free travel is provided up and down the dock or piling as may be required due to the ebb and flow of the tide. Because of this free travel, the lines adjust with the tide and need not be re-adjusted. The invention also allows lines to be tied off in a spring line arrangement utilizing only two lines to hold the vessel fast if desired.

Accordingly, it is a principal object of the present invention to provide a new and improved mooring line system.

Another object of the invention is to provide a boat mooring apparatus which permits the craft so moored to rise and fall with the tide or wave action.

A still further object of the invention is to provide a boat mooring attachment for a dock or pier which is rugged and long wearing and inexpensive to manufacture.

Yet another object of the invention is to provide a boat mooring device which includes a mooring line roller and chafe resistor.

These and other objects of the invention will become apparent to those skilled in the art to which the invention pertains when taken in light of the annexed drawings.

DESCRIPTION OF THE PREFERRED EMBODIMENT

Figure 1:
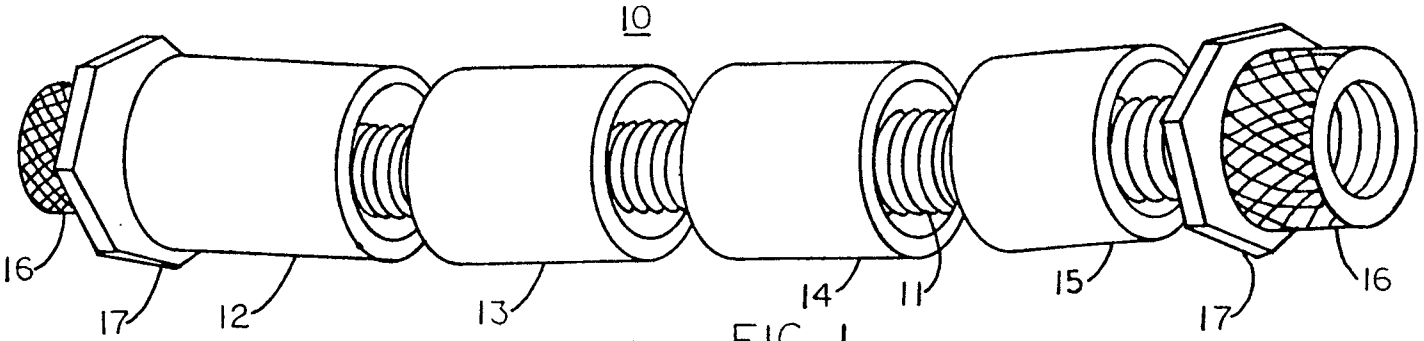
FIG. 1 shows an expanded view in perspective, of a mooring line roller and chafe resistor of the present invention.
Figure 3:
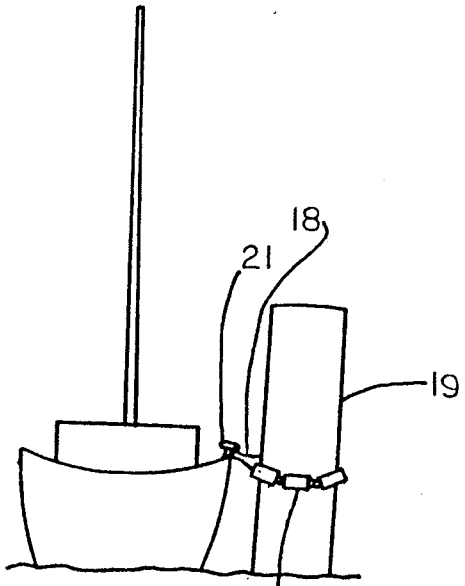
FIG. 3 shows an end view of a boat moored in accordance with the invention.

Referring now in more detail to the drawings, FIG. 1 shows a mooring line roller and chafe resistor 10 which includes ribbed tube 11 and spools or rollers 12, 13, 14, and 15 mounted on the tube 11. The spools or rollers 12–15 are mounted in the preferred embodiment without bearings or other inner workings, but are placed loosely to facilitate easy movement. The invention is constructed of a high impact plastic material which has been formed into spools or rollers 12–15 of a type which are hollow throughout but having a solid shell which is approximately ⅛" in thickness. The plastic materials may be of other thicknesses and widths and sizes in accordance with the various sizes of mooring lines used on a wide range of boat lengths. In one preferred embodiment, the rollers or spools 12–15 are mounted on a length of flexible tubing approximately 1" in diameter and 18" in length. The flexible ribbed tube 11 may be made from many different diameters and lengths to meet the varying conditions and requirements.

As shown in FIG. 1, the invention is also provided with two end cap flanges 16 which are of plastic similar to the composition utilized in the roller or spool 12–15 portion, but having an octagonal outer lip 17 and a tube type center. The end caps 16 are screwed onto each end of tube 11 and serve to contain the rollers or spools 12–15 upon the tube 11. End cap flanges 16 are larger than the roller or spools 12–15 to prevent the spools from sliding off or otherwise detaching from the ribbed tube 11. FIG. 1 shows the invention utilizing four spools or rollers 12–15 and a length of tube 11. This illustration is for the purpose of providing a general description of the invention, and as stated above may be constructed in many sizes, widths, and lengths depending upon the specific application. The spools or rollers 12–15 are mounted in this application without bearings or other inner workings, but are placed loosely to facilitate free movement.

Figure 2:
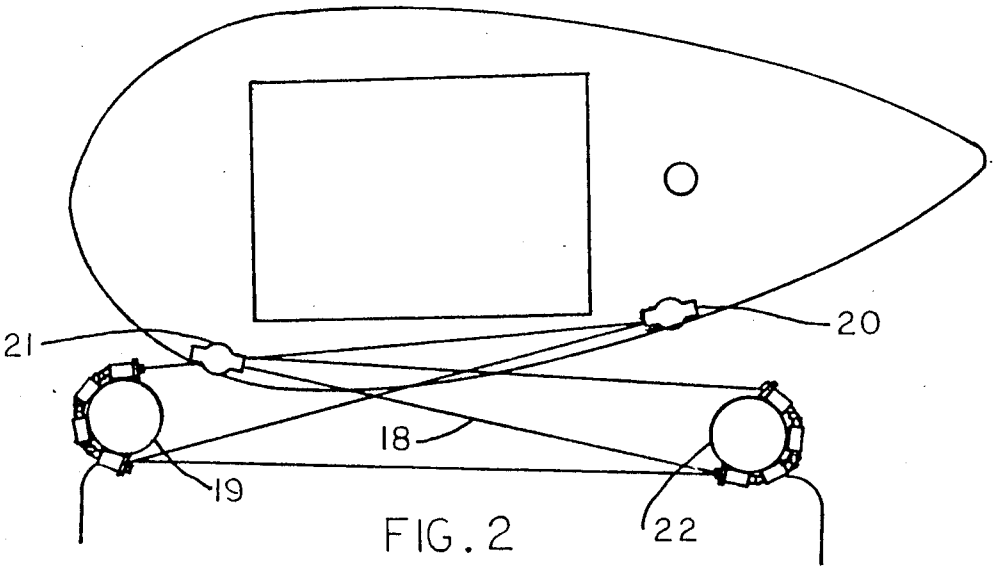
FIG. 2 shows a top view of a boat moored in accordance with the invention.

As shown in FIG. 2, the chafe resistor 10 is designed to be fitted onto the dock lines 18 by inserting a dock line 18 into either end of tube 11 and sliding the chafe resistor 10 along the dock line 18 to the desired point depending upon the intentions of the individual application. A first end of the dock line 18 is tied to a first cleat 20 and the chafe resistor 10 is placed at a point of contact with the dock post 19 so that the chafe resistor 10 and not the dock line 18 makes contact with the post 19 directly. A second end of the dock line 18 is then brought forward and tied to cleat 20, thus completing the loop. Once the chafe resistor 10 is in position, it will roll freely up or down on the dock post 19 thereby allowing the dock line 18 free travel up or down the post 19. The up and down movement of the vessel is caused by tides and the chafe resistor 10 is designed to allow for such movement in an unrestricted manner. A second dock line 18 is then tied to a second cleat 21 and the assembly of the chafe resistor 10 is repeated with contact at dock post 22 and then aft to cleat 21 where it is tied. The chafe resistor 10 of the invention permits lines to be tied off in a spring line arrangement utilizing only two lines to hold the vessel fast if one so desired.

While the invention has been explained with respect to a preferred embodiment thereof, it is contemplated that various changes may be made in the invention without departing from the spirit and scope thereof.

What is claimed is:

1. A dock and mooring line roller and chafe resistor adapted to allow vertical movement of a moored vessel comprising:

a spiral wound, high impact, plastic tube;

a plurality of high impact plastic spools disposed on said tube and having a longitudinal inside diameter sufficient to permit a loose fit when disposed on said tube and having an outer thickness of at least $\frac{1}{8}''$, and a first end cap flange mounted on a first end of said tube and a second end cap flange mounted on a second end of said tube, said first and second end cap flanges consisting of high impact plastic.

2. A dock and mooring line roller and chafe resistor adapted to allow vertical movement of a moored vessel comprising:

a flexible, spiral wound, plastic tube, adapted to receive a mooring line, a plurality of spools disposed on said tube and adapted to roll as said mooring line rises and falls, and a first end cap flange mounted on a first end of said tube and a second end cap flange mounted on a second end of said tube.

* * * * *